United States Patent [19]

Usher

[11] 4,063,591

[45] Dec. 20, 1977

[54] PLATE HEAT EXCHANGERS

[75] Inventor: John Dennis Usher, Redhill, England

[73] Assignee: The A.P.V. Company Limited, Crawley, England

[21] Appl. No.: 633,630

[22] Filed: Nov. 20, 1975

[30] Foreign Application Priority Data

Dec. 20, 1974 United Kingdom ..... 55105/74

[51] Int. Cl.[2] ..... F28F 3/10

[52] U.S. Cl. ..... 165/167

[58] Field of Search ..... 165/166, 107

[56] References Cited

U.S. PATENT DOCUMENTS

| | | | |
|---|---|---|---|
| 2,075,236 | 3/1937 | Seligman et al. | 165/167 |
| 3,532,161 | 10/1970 | Lockel | 165/167 |
| 3,792,730 | 2/1974 | Andersson | 165/167 |

FOREIGN PATENT DOCUMENTS

| | | | |
|---|---|---|---|
| 985,955 | 3/1965 | United Kingdom | 165/167 |
| 1,346,312 | 2/1974 | United Kingdom | 165/167 |

*Primary Examiner*—Ronald H. Lazarus
*Assistant Examiner*—Theophil W. Streule, Jr.
*Attorney, Agent, or Firm*—Christel & Bean

[57] ABSTRACT

A plate heat exchanger comprising a separable pack of gasketed plates defining flow spaces between the plates and having port-forming apertures, the apertures in communication with the flow spaces being provided in the zones of communication with castellated strips to provide interplate support in the region of the gasket sealing the ports from the adjacent flow spaces, and the said sealing gaskets being housed in grooves having spaced reinforcing recesses on at least one wall, each said reinforcing recess being supported by a castellation of the strip and the spacing of the reinforcing recesses being such that one or more castellations is located between each pair of recess-supporting castellations. The invention further extends to single plates of such a pack.

4 Claims, 5 Drawing Figures

PLATE HEAT EXCHANGERS

This invention relates to plate heat exchangers.

A plate heat exchanger comprises a separable pack of plates arranged in spaced face-to-face relationship to define flow spaces between the plates. The plates have aligned apertures to define ports for the supply and discharge of the heat exchange media to and from the flow spaces. Gaskets are provided to define the boundaries of the flow spaces and also to seal the flow spaces for one medium from the ports for the other medium.

The pack of plates is normally compressed in a frame to provide sealing pressure on the gaskets and the operating pressures within the flow spaces are frequently very high. For purpose of economy in metal and efficiency in heat exchange, it is desirable to have the metal of plates as thin as practicable and therefore the plates have to be so formed as to have reinforcing formations at the zones of great stress, and these formations, when they are integral with the plate, must be such as to be pressed into the plate without an excessive risk of splitting the metal. This last requirement is particularly important if titanium is to be used in place of the conventional stainless steel for special duties.

The problems of interplate support and reinforcement are particularly great in the so-called bridge zones of communication between the ports and the flow space zones. At these locations the plate has to provide and withstand the sealing pressure from the gaskets on the adjacent plates sealing the ports from the flow space, and yet be open to provide free flow between the port and the flow space. With larger plate sizes it is usually the most practicable solution to weld on some reinforcement in the form of a castellated strip.

Another problem arising in the region of the gaskets round the ports is that the gasket tightening load or sealing pressure may cause the wall defining the gasket recess adjacent the port aperture to flex into the aperture, giving rise to the possibility of leakage. This problem is conventionally overcome by providing reinforcing formations in the form of pressed recesses on this wall of the gasket recess, with corresponding protuberances on the gasket. The castellations are then extended to support the undersides of these recesses so that the pitches of the recesses and castellations are conventionally equal and one castellation corresponds to one recess.

For reasons of strength, it is necessary to make the pitch of the castellations as close as possible and this therefore applies to the pitch of the recesses. However, a further limitation is then encountered because in less ductile materials the press-forming of these recesses could cause splitting.

According to a first aspect of the present invention, there is provided a plate heat exchanger comprising a separable pack of gasketed plates defining flow spaces between the plates and having port-forming apertures, the apertures in communication with the flow spaces being provided in the zones of communication with castellated strips to provide interplate support in the region of the gasket sealing the ports from the adjacent flow spaces, and the said sealing gaskets being housed in grooves having spaced reinforcing recesses on at least one wall, each said reinforcing recess being supported by a castellation of the strip and the spacing of the reinforcing recesses being such that one or more castellations is located between each pair of recess supporting castellations.

According to a second aspect of the present invention, there is provided a heat exchanger plate having a flow space zone and port-forming apertures, two of the port-forming apertures having gasket grooves adapted to seal the apertures from the flow space zone, the said grooves being formed with spaced reinforcing recesses on their walls adjacent the apertures, and two of the apertures being associated with zones having castellated strips adapted to cooperate with the gasket grooves of adjacent corresponding plates to provide interplate support, the castellated strips being so located as to provide a castellation for supporting each reinforcing recess on the adjacent plate and at least one additional castellation between each pair of recess-supporting castellations.

Preferably, the castellations are equally pitched and the pitch of the reinforcing recesses is an integral multiple of the pitch of the castellations.

The invention will be further described with reference to the accompanying drawings, in which.

Figure 1:
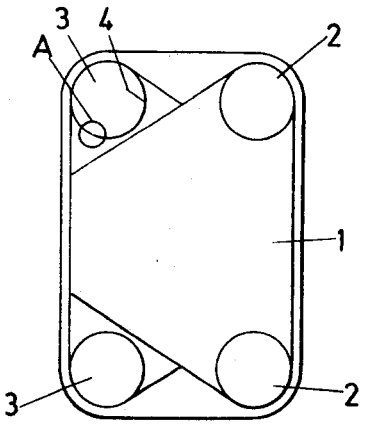
FIG. 1 is an elevation of a typical form of heat exchanger plate to which the present invention may be applied.

FIG. 1 shows a plate having a flow space zone 1 communicating with one pair of ports 2 and sealed from the other pair of ports 3. The ports 3 are provided with gaskets 4 in gasket grooves 5.

Figure 3:
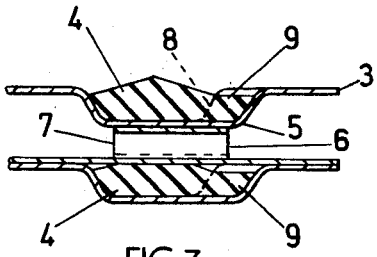
FIG. 3 is a section taken along the line X — X of FIG. 2 showing portions of three plates.

The areas around the ports are critical from the point of view of mechanical strength as the port entry gap 6, FIG. 3, must be maintained against the loading of the adjacent rubber gaskets 4. Failure to do this will both close the gap and cause leakage past the gasket.

Figure 2:
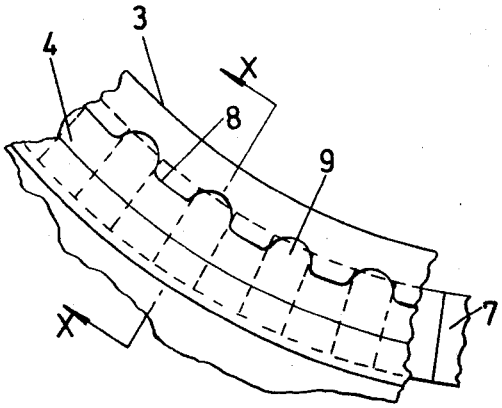
FIG. 2 is an enlarged scrap elevation taken within the zone indicated by the circle A in FIG. 1 and showing also a part of one adjacent plate, according to conventional practice.

When plates are manufactured in expensive materials such as titanium (which is relatively weak), it is important to make them as thin as possible for economic reasons and the necessary plate support is provided by a castelled strip 7 welded in the port entry gap 6. However, the gasket tightening load tends to make the unsupported flank 8 of the gasket groove 5 bend outwards into the port area. This is prevented by forming spaced recesses 9 into that side of the groove 5 and extending the castellations so that they support the underside of these recesses. It will be seen that in FIG. 2 the number of recesses is equal to the number of castellations.

In order to obtain maximum strengthening from the castellated strip 7, the pitch of the castellations should be as small as possible, but a one-to-one correspondence between castellations and the reinforcing recesses 9 could then lead to splitting of the plate metal on pressing of the recesses 9, particularly if titanium is used.

Figure 5:
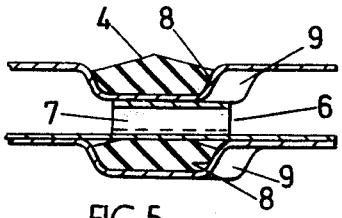
FIG. 5 is a section on the line Y — Y of FIG. 4.
Figure 4:
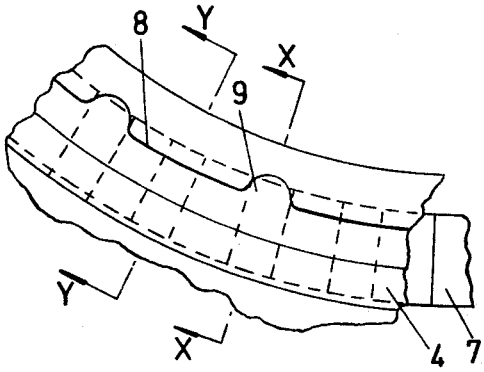
FIG. 4 is a view similar to FIG. 2 showing an embodiment of the present invention.

FIGS. 4 and 5 show an arrangement according to the invention in which the recesses 9 are at twice the pitch of the castellations so that one castellation occurs between each pair of recesses 9. The sectional view along line X—X of FIG. 4 is the same as FIG. 3. It will be appreciated that it is also possible to space the recesses even further apart so that there are two or more castellations between each pair of recesses if the pressing requirements so dictate, in order to avoid splitting during pressing of the recesses 9.

Various other modifications may be made within the scope of the invention.

I claim:

1. In a plate heat exchanger comprising a separable pack of gasketed plates defining flow spaces between the plates having port-forming apertures, grooves adjacent said apertures and sealing gaskets contained in said grooves, the flow space between adjacent plates being in communication with an aperture through a port entry gap maintained between the groove of one plate and the adjacent plate, the apertures in communication with the flow spaces being provided with castellated strips fixed in the port entry gaps to provide interplate support in the region of the gasket sealing the ports from the adjacent flow spaces, each of said castellated strips comprising spaced-apart first surface portions along a common plane, spaced-apart second surface portions spaced along a common plane parallel to the plane of said first portions said first and second portions being staggered along said strip, and said first and second portions being joined by linking surface portions disposed at right angles to the planes of the first and second portions, said grooves having spaced reinforcing recesses on at least one wall: the improvement that the castellated strip is located with respect to said groove such that each said reinforcing recess is supported by a castellation of the strip and the spacing of the reinforcing recesses is such that at least one castellation is located between each two recess-supporting castellations so that the pitch of said reinforcing recesses is an integral multiple of the pitch of said castellations.

2. A plate heat exchanger as claimed in claim 1 in which the castellations are equally pitched.

3. In a heat exchanger plate having a zone for defining a flow space with an adjacent plate and port-forming apertures, two of the port-forming apertures having gasket grooves adapted to seal the apertures from the flow space zone, the said grooves being formed with spaced reinforcing recesses on their walls adjacent the apertures, two of the apertures being in communication with said zone castellated strips fixed to said plate adjacent said apertures adapted to cooperate with the gasket grooves of adjacent corresponding plates to provide interplate support: the improvement being that the castellated strips are so located as to provide a castellation for supporting each reinforcing recess on the adjacent plate and at least one additional castellation between each pair of recess-supporting castellations so that the pitch of said reinforcing recesses is an integral multiple of the pitch of said castellations.

4. A heat exchanger plate as claimed in claim 3, in which the castellations are equally pitched.

* * * * *